US010605264B2

(12) United States Patent
Fang et al.

(10) Patent No.: US 10,605,264 B2
(45) Date of Patent: Mar. 31, 2020

(54) DIFFUSER, AIRFLOW GENERATING APPARATUS, AND ELECTRICAL DEVICE

(71) Applicant: Johnson Electric S.A., Murten (CH)

(72) Inventors: Chuan Hui Fang, Hong Kong (CN); Feng Xue, Shenzhen (CN); Hong Guang Li, Shenzhen (CN); Huan He, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 703 days.

(21) Appl. No.: 15/240,324

(22) Filed: Aug. 18, 2016

(65) Prior Publication Data

US 2017/0051756 A1 Feb. 23, 2017

(30) Foreign Application Priority Data

Aug. 21, 2015 (CN) ..... 2015 1 0520945

(51) Int. Cl.
*F04D 29/44* (2006.01)
*F04D 29/28* (2006.01)
(Continued)

(52) U.S. Cl.
CPC ..... *F04D 29/444* (2013.01); *F04D 17/165* (2013.01); *F04D 25/08* (2013.01); *F04D 29/281* (2013.01); *F04D 29/4213* (2013.01); *F05B 2240/12* (2013.01); *F05B 2240/14* (2013.01); *F05B 2240/20* (2013.01); *F05B 2250/502* (2013.01); *F05B 2260/96* (2013.01); *F05D 2250/52* (2013.01)

(58) Field of Classification Search
CPC ..... F04D 29/444
See application file for complete search history.

(56) References Cited

U.S. PATENT DOCUMENTS 4,767,285 A * 8/1988 Jyoraku ..... F04D 25/06 415/119
2014/0147311 A1 5/2014 Jung et al.

FOREIGN PATENT DOCUMENTS

DE 19605742 A1 8/1997
JP 2013029034 A 2/2013
(Continued)

*Primary Examiner* — David E Sosnowski
*Assistant Examiner* — Juan G Flores
(74) *Attorney, Agent, or Firm* — Muncy, Geissler, Olds & Lowe, PC

(57) ABSTRACT

A diffuser, an airflow generating apparatus, and an electrical device are provided. The airflow generating apparatus includes a motor; an impeller including blades with air passages formed therebetween; and a diffuser including diffusing vanes with diffusing channels formed therebetween. In a flow region defined between a terminating end of one diffusing vane and a starting end of another adjacent diffusing vane, an intersection line between a bottom of the diffusing channel between the two diffusing vanes and its circumferential section includes a front arcuate line segment and a subsequent straight line segment, the arcuate line segment extends curvedly, outwardly and downwardly from or from adjacent an inlet end of the diffusing channel, the straight line segment connects to the arcuate line segment and extends to an outlet end of the diffusing channel. The diffusing channel is designed to improve the operating efficiency of the airflow generating apparatus.

17 Claims, 12 Drawing Sheets

(51) Int. Cl.

| | |
|---|---|
| ***F04D 25/08*** | (2006.01) |
| ***F04D 29/42*** | (2006.01) |
| ***F04D 17/16*** | (2006.01) |

(56) References Cited

FOREIGN PATENT DOCUMENTS

| | | | |
|---|---|---|---|
| KR | 20130091841 | A | 8/2013 |
| WO | WO 97/19629 | A1 | 6/1997 |

* cited by examiner

DIFFUSER, AIRFLOW GENERATING APPARATUS, AND ELECTRICAL DEVICE

CROSS REFERENCE TO RELATED APPLICATIONS

This non-provisional patent application claims priority under 35 U.S.C. § 119(a) from Patent Application No. 201510520945.0 filed in The People's Republic of China on Aug. 21, 2015.

FIELD OF THE INVENTION

The present invention relates to an air generating apparatus, and in particular to a high efficient air generating apparatus, a diffuser of the air generating apparatus, and an electrical device utilizing the air generating apparatus.

BACKGROUND OF THE INVENTION

Airflow generating apparatuses are a key part for devices whose operation relies on airflow, such as hair dryers, hand dryers or vacuum cleaners. The efficiency of the airflow generating apparatus also directly affects the efficiency of these devices. Therefore, in order to enhance the efficiency of these devices, improvement of the efficiency of the airflow generating apparatus has become an important subject to study.

A typical airflow generating apparatus includes a motor, an impeller and a diffuser. The diffuser surrounds the impeller, the impeller is driven by the motor to rotate, and the air entering the impeller passes through the diffuser and is finally discharged from openings of a motor housing.

The construction of the diffuser is vitally important because it affects the efficiency of the airflow generating apparatus. A high efficient diffuser can increase airflow, or reduce the power consumed to achieve the same airflow. Therefore, it is highly desirable for providing a high efficient diffuser and hence enhancing the efficiency of the airflow generating apparatus.

SUMMARY OF THE INVENTION

Thus, there is a desire for an airflow generating apparatus with improved efficiency.

In one aspect, an airflow generating apparatus is provided which includes a motor comprising a rotary shaft; an impeller mounted on the rotary shaft of the motor for being driven by the motor, the impeller comprising a plurality of blades, air passages being formed between the blades; and a diffuser surrounding the impeller and comprising a plurality of diffusing vanes, diffusing channels being formed between the diffusing vanes. In a flow region defined between a terminating end of one diffusing vane and a starting end of another adjacent diffusing vane, an intersection line between a bottom of the diffusing channel between the two diffusing vanes and a circumferential section of the bottom of the diffusing channel comprises a front arcuate line segment and a subsequent straight line segment, the arcuate line segment extends curvedly, outwardly and downwardly from an inlet end of the diffusing channel or a portion adjacent the inlet end of the diffusing channel, the straight line segment connects to the arcuate line segment and extends to an outlet end of the diffusing channel.

Preferably, the circumferential section of the bottom of the diffusing channel is an airfoil section.

Preferably, the straight line segment is tangent to the arcuate line segment at a point where they are connected to each other.

Preferably, the bottom of the diffusing channel comprises a front curved bottom segment and a subsequent plane bottom segment.

Preferably, a chord height of the arcuate line segment is c, a chord length of the arcuate line segment is b, c is 0.14 to 0.16 times b, and one end of the arcuate line segment away from the straight line segment and a plane perpendicular to a central axis of the diffuser form therebetween an angle in the range of 20 to 30 degrees.

Preferably, wherein the straight line segment has a length d, and d is 02 to 0.3 times b.

Preferably, the arcuate line segment has a point with a maximum degree of curvature, a projection point of the point with the maximum degree of curvature on a chord of the arcuate line segment is spaced from one end point of the arcuate line segment by a distance a, and a is 0.4 to 0.6 times b.

Preferably, an angle β formed between the straight line segment and the plane perpendicular to a central axis of the diffuser is 90 degrees.

Preferably, the inlet end of the diffusing channel is spaced from the air passages of the impeller by a gap.

Preferably, the impeller has an outer diameter D1, a circle on which ends of the diffusing vanes at the inlet end of the diffusing channels are located has a diameter D2, and D1 is 0.85 to 0.98 times D2.

Preferably, the impeller comprises a front cover plate and a rear cover plate spaced apart by a predetermined distance. The front cover plate defines an opening as an inlet of the air passages of the impeller, and an outer circumference of the impeller Runs an outlet of the air passages.

Preferably, the diffuser comprises an outer housing and a partition plate disposed within the outer housing, and the plurality of diffusing vanes is formed on the partition plate.

Preferably, a thickness increased stage is formed along an outer circumferential area of the partition plate, and the diffusing vanes extend across the thickness increased stage to an outer edge of the diffuser where the diffusing vanes connect to the outer housing.

Preferably, the partition plate forms a recessed portion at a middle thereof, and the impeller is disposed in the recessed portion.

Preferably, the outlet ends of the diffusing channels pass through the partition plate and is disposed adjacent the outer housing, a gap is defined between the outer housing and the outlet ends of the diffusing channels.

Preferably, the airflow generating apparatus further comprising a cover body defining an opening which acts as an inlet allowing the air to enter the airflow generating apparatus.

Preferably, the opening is trumpet-shaped which has a caliber at its upper end greater than its caliber at its lower end, and a volume of the opening is 1 to 1.2 times a volume of a cylinder having a diameter the same as the caliber at the lower end of the opening and having the same height as the opening.

Preferably, the opening is cylindrical.

In another aspect, a diffuser for use in an airflow generating apparatus is provided which includes a plurality of diffusing vanes, with diffusing channels formed between the diffusing vanes. In a flow region defined between a terminating end of one diffusing vane and a starting end of another adjacent diffusing vane, an intersection line between a bottom of the diffusing channel between the two diffusing vanes and a circumferential section of the bottom of the diffusing channel comprises a front arcuate line segment and a subsequent straight line segment, the arcuate line segment extends curvedly, outwardly and downwardly from or from adjacent an inlet end of the diffusing channel, and the straight line segment connects to the arcuate line segment and extends to an outlet end of the diffusing channel.

In other aspects, a hand dryer, a vacuum cleaner and a hair dryer as electrical devices using the above airflow generating apparatus are also provided.

The present invention can improve the efficiency of the airflow generating apparatus.

DETAILED DESCRIPTION OF THE PREFERRED EMBODIMENTS

Figure 1:
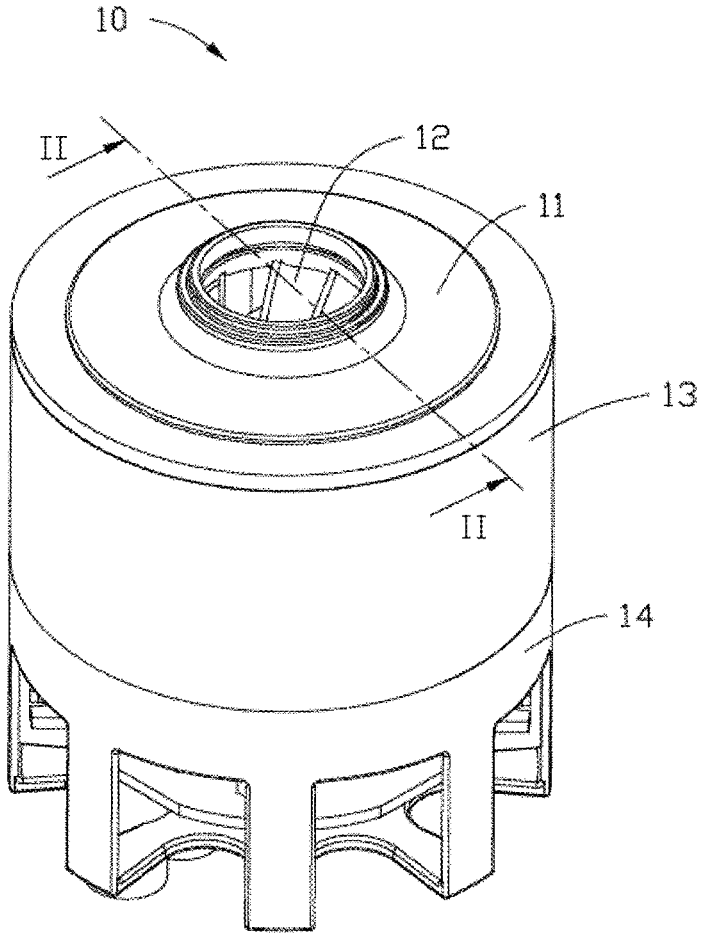
FIG. 1 is a perspective view of an airflow generating apparatus according to one embodiment of the present invention.
Figure 2:
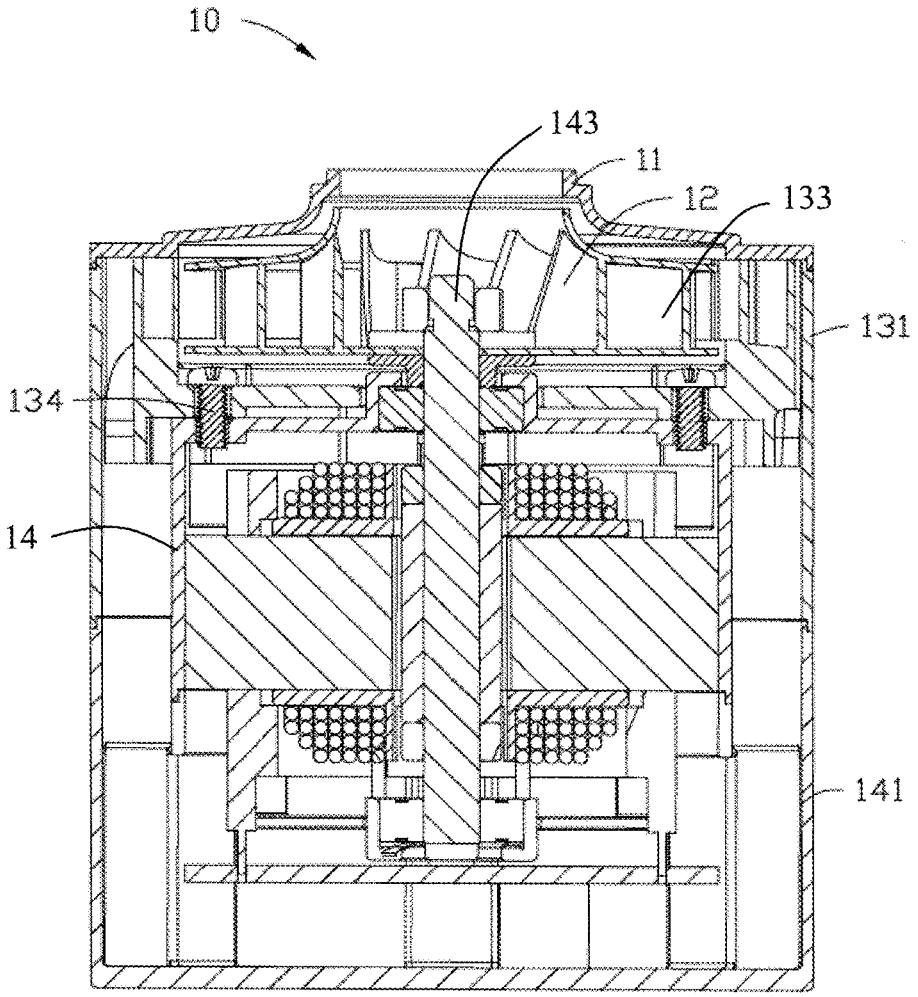
FIG. 2 is sectional view of the airflow generating apparatus of FIG. 1, taken along line II-II thereof.

Referring to FIG. 1 and FIG. 2, an air generating apparatus 10 in accordance with one embodiment of the present invention includes a cover body 11, a centrifugal impeller 12, a diffuser 13, and a motor 14. The centrifugal impeller 12 is disposed in the diffuser 13, and the diffuser 13 surrounds the centrifugal impeller 12. The centrifugal impeller 12 is mounted to a rotary shaft 143 of the motor 14 for being driven by the motor 14 to rotate. The diffuser 13 is mounted on a motor housing 141 of the motor 14 with screws 134. The cover body 11 is mounted above the centrifugal impeller 12, the diffuser 13 and the motor 14. An opening 111 (see FIG. 10 and FIG. 11) of the cover body 11 forms an air inlet of the airflow generating apparatus 10. The air entering via the opening 111 of the cover body 11 passes through the centrifugal impeller 12 and the diffuser 13 and is finally discharged from openings of the motor housing 141 of the motor 14.

Figure 3:
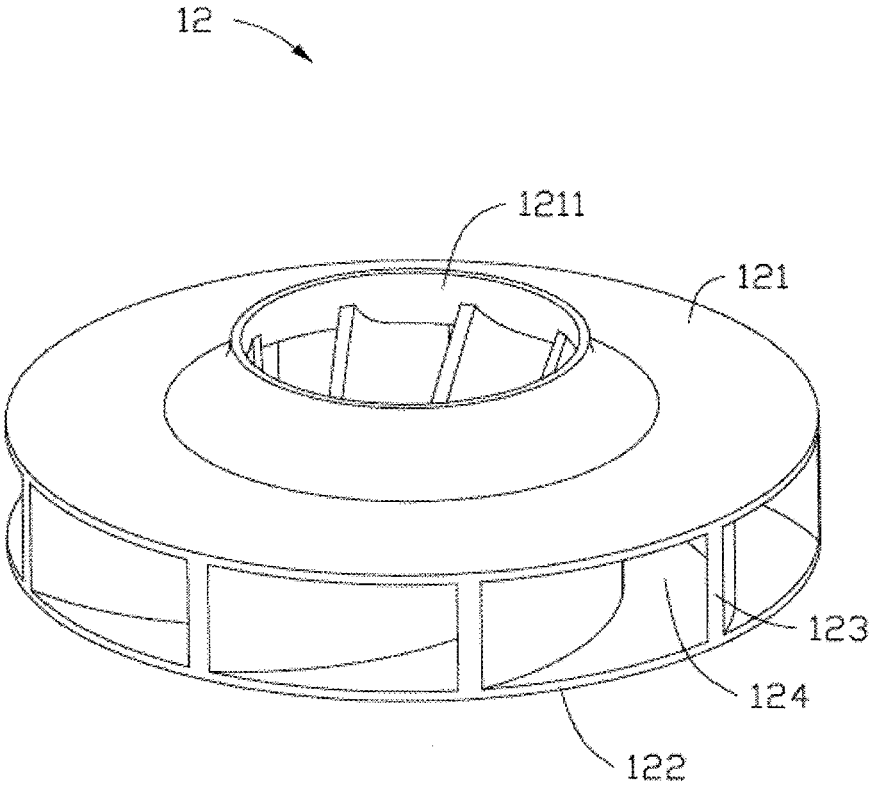
FIG. 3 is a perspective view of a centrifugal impeller used in the airflow generating apparatus of FIG. 1.
Figure 4:
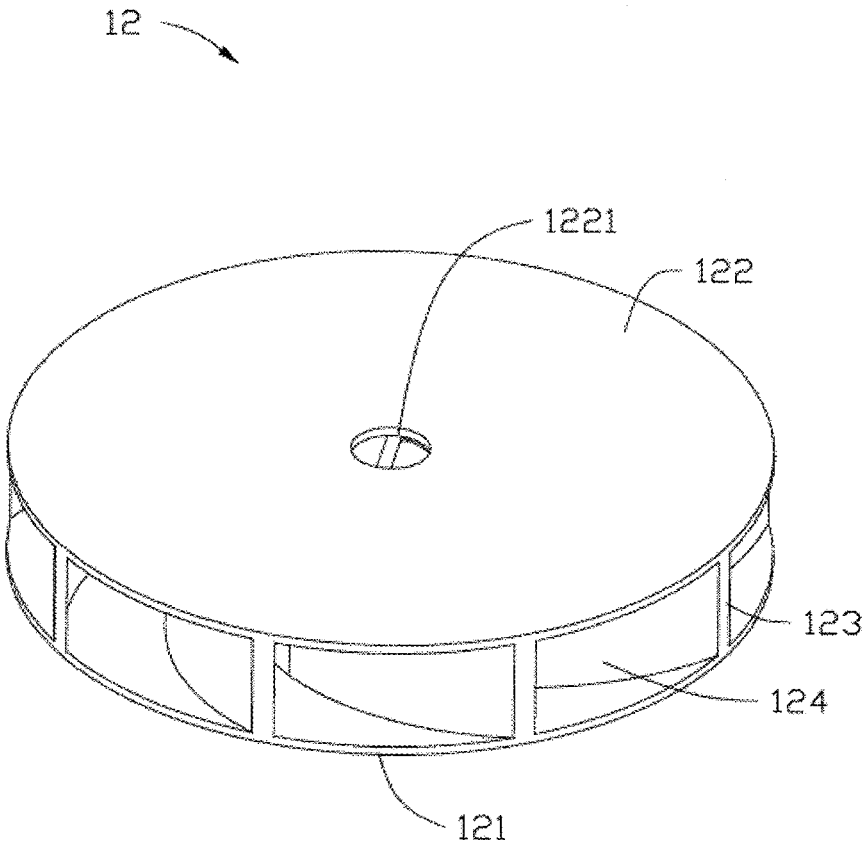
FIG. 4 is similar to FIG. 3, but viewed from another aspect.
Figure 5:
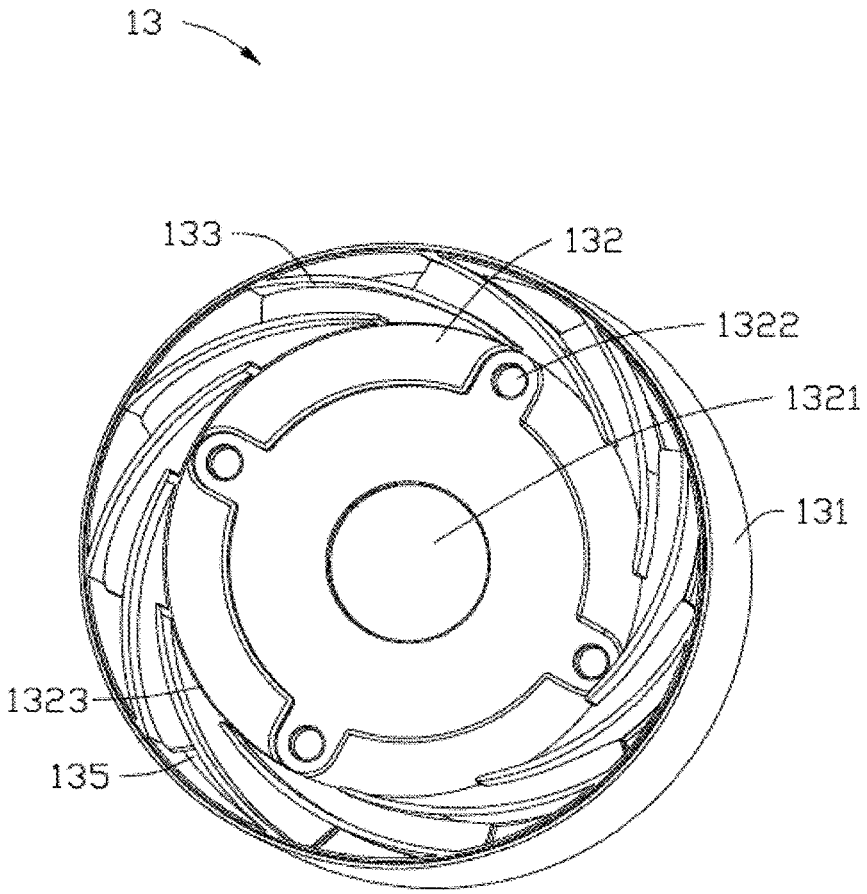
FIG. 5 is a perspective view of a diffuser used in the airflow generating apparatus of FIG. 1.
Figure 6:
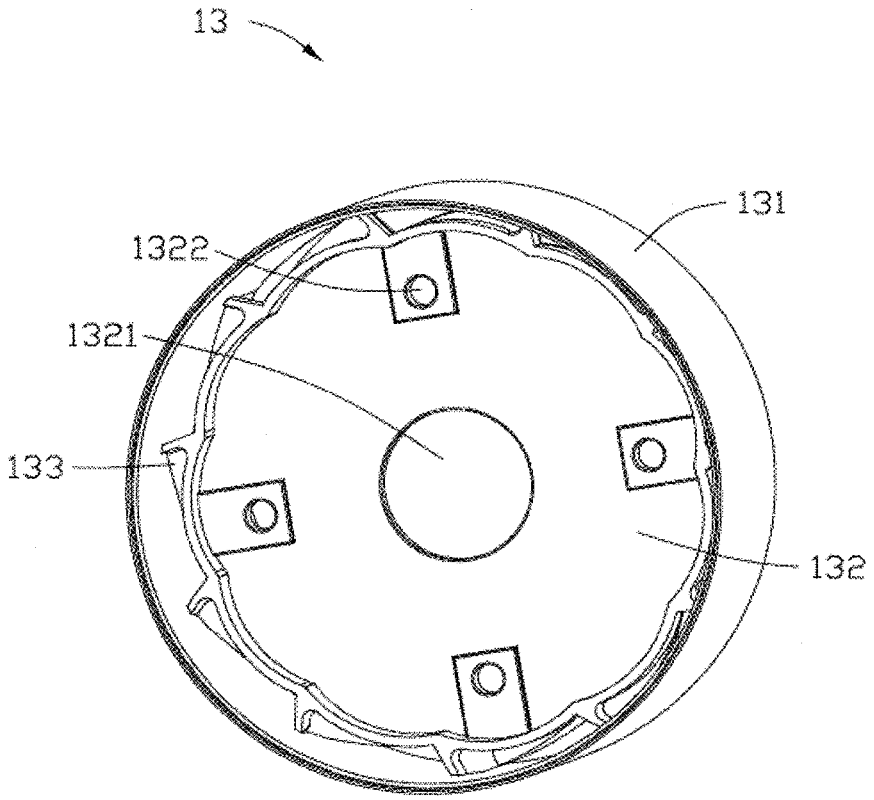
FIG. 6 is similar to FIG. 5, but viewed from another aspect.

Referring to FIG. 3 and FIG. 4, the centrifugal impeller 12 includes a front cover plate 121 and a rear cover plate 122 spaced apart by a predetermined distance, and it further includes a plurality of blades 123 mounted between the front cover plate 121 and the rear cover plate 122. Air passages 124 are defined between adjacent blades 123. An opening 1211 is defined in a central position of the front cover plate 121, which is aligned with the opening 111 of the cover body 11 and acts as an inlet of the air passages 124 of the centrifugal impeller 12. An outer circumference of the centrifugal impeller 12 defines outlets of the air passages 124. A through hole 1221 is defined in a central position of the rear cover plate 122. The through hole 1221 allows the rotary shaft 143 of the motor 14 to pass therethrough so as to mount the centrifugal impeller 12 to the rotary shaft 143 of the motor 14. The centrifugal impeller 12 can be driven by the motor 14 to rotate.

Referring to FIG. 2, FIG. 5, FIG. 6, and FIG. 8, the diffuser 13 includes an outer housing (e.g. a cylindrical outer housing) 131, and a partition plate 132 and a plurality of diffusing vanes 133 disposed in the outer housing 131. The partition plate 132 includes a through hole 1321 for allowing the rotary shaft 143 of the motor 14 to pass therethrough. The partition plate 132 further includes a plurality of through holes 1322 for allowing the screws 134 to pass therethrough so as to mount the diffuser 13 to the motor housing 141. The outer housing 131 surrounds an outer circumference of an upper portion of the motor 14, with a gap defined therebetween to form an air channel A stepped structure is formed along an outer circumferential area of the partition plate 132, such that a thickness increased stage 1323 is formed on a circumferential edge of the partition plate 132, and a recessed portion is formed on a middle of the partition plate 132. The diffusing vanes 133 extend upwardly from the thickness increasing stage 1323 and extend across the thickness increased state 1323 along a curved path to an outer edge of the diffuser 13 where the diffusing vanes 133 connect to the outer housing 131. Diffusing channels 135 are defined between the diffusing vanes 133. The centrifugal impeller 12 is disposed in the recessed portion, with the diffusing vanes 133 disposed surrounding the centrifugal impeller 12. Inlet ends of the diffusing channels 135 are adjacent the outlets of the air passages 124 of the centrifugal impeller 12, and a gap is defined between the inlet ends of the diffusing channels 135 and the outlets of the air passages 124.

Figure 7:
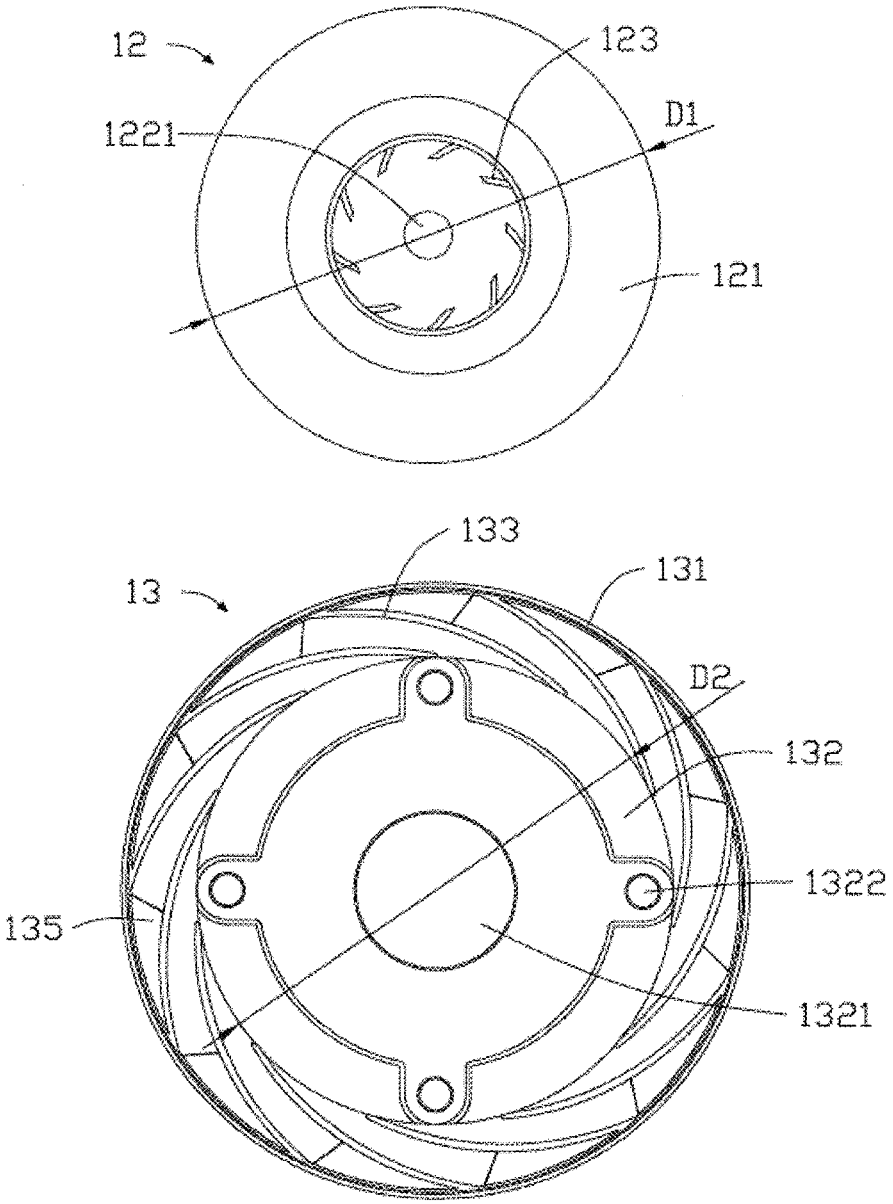
FIG. 7 is a view showing the proportion between the centrifugal impeller of FIG. 3 and the diffuser of FIG. 5.

Referring to FIG. 7, the centrifugal impeller 12 has an outer diameter indicated by D1, and the circle on which the ends of the diffusing vanes 133 at the inlet ends of the diffusing channels 135 are located has a diameter indicated by D2. The outer diameter D1 of the centrifugal impeller 12 is 0.85 to 0.98 times the diameter D2 of the circle on which the ends of the diffusing vanes 133 are located. As a result, the gap is defined between the inlet ends of the diffusing channels 135 and the outlets of the air passages 124 of the centrifugal impeller 12. The presence of the gap reduces the noise of the airflow generating apparatus 10 during operation while having more limited impact on the efficiency of the airflow entering the diffuser 13 from the centrifugal impeller 12.

Figure 8:
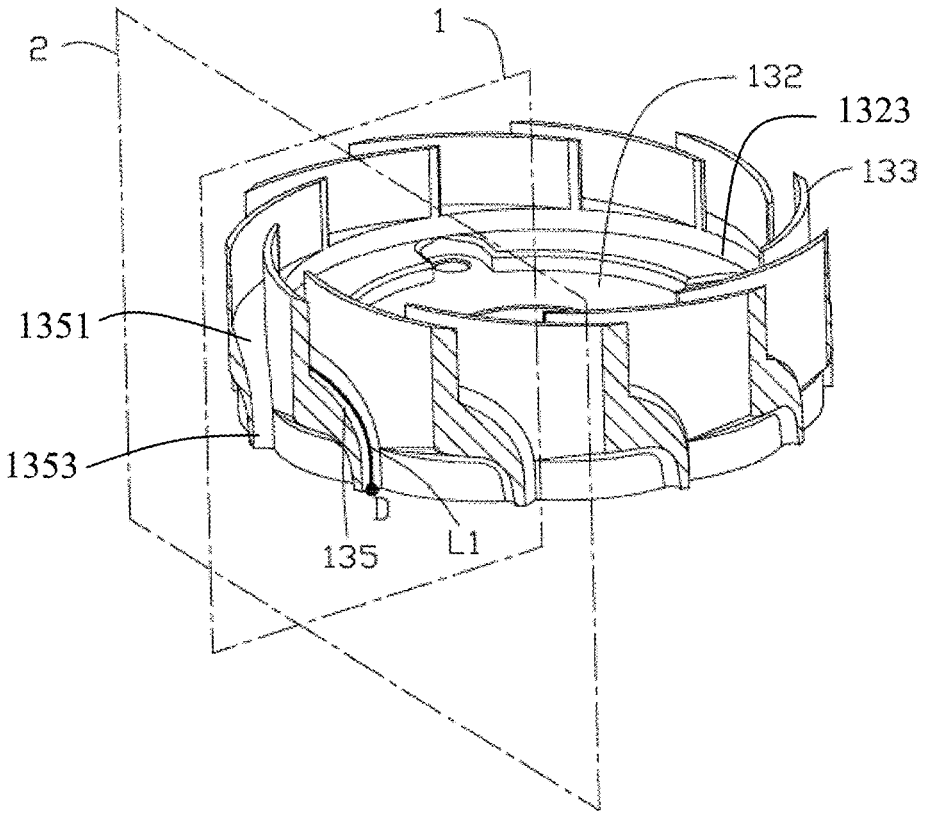
FIG. 8 illustrates the diffuser of FIG. 5, with the cylindrical outer housing removed to expose its diffusing channel.

Referring to FIG. 8, in one embodiment, a bottom of each diffusing channel 135 from the inlet end to the outlet end thereof is formed by a curved bottom segment 1351 and a plane bottom segment 1353. The curved bottom segment 1351 extends curvedly, outwardly and downwardly from the inlet end of the diffusing channel 135. That is, the curved bottom segment 1351 is a downwardly inclined curved surface having a degree of curvature. The plane bottom segment 1353 connects to the curved bottom segment 1351 and extends to the outlet end of the diffusing channel 135. The inlet end of the diffusing channel 135 is adjacent the centrifugal impeller 12, the outlet end of the diffusing channel 135 passes through the partition plate 132 and is disposed adjacent the outer housing 131 with a space defined between the outlet end of the diffusing channel 135 and the outer housing 131, such that the air enters the air channel between the outer housing 131 and the motor housing 141 through this gap, and is finally discharged from the openings of the motor housing 141. In an alternative embodiment, the plane bottom segment 153 may also be replaced with another curved bottom segment such as a cylindrical surface or a conical surface.

In designing the diffusing channel 135, references have been made to the principle of airfoil aerodynamic design, which facilitates enhancing the air flow efficiency. In one embodiment, a circumferential section of the bottom of the diffusing channel 135 is an airfoil section.

Figure 9:
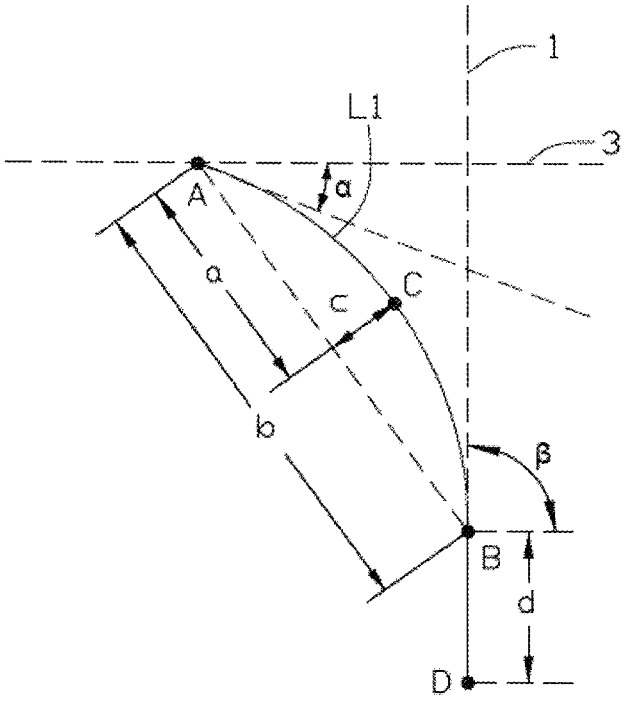
FIG. 9 is a view showing a section of a bottom of the diffusing channel of the diffuser of FIG. 8 and section parameters thereof.

Referring to FIG. 8 and FIG. 9, in a flow region defined between a terminating end of one diffusing vane 133 and a starting end of another adjacent diffusing vane 133, an axial section extending along any radius direction in the flow region is defined as plane 1. A section passing the diffusing channel 135, perpendicular to the plane 1 and parallel to the axial direction of the impeller 13 is defined as a circumferential section 2 of the diffusion channel 135. An intersection line between the bottom of the diffusing channel 135 and the circumferential section 2 is indicated by L1. In one embodiment, the bottom of the diffusing channel 135 is designed by reference to a simple mean camber line of the five-digit airfoil series, which has a cubic-curved front segment and a subsequent straight segment. In other embodiments, the front segment of the diffusing channel 135 may be another high-order curve segment and the subsequent segment is the straight segment.

The line L1 includes an arcuate line segment AB and a straight line segment BD. The point A of the arcuate line segment AB is disposed adjacent or at the inlet end of the diffusing channel 135, and the point D of the straight line segment BD is disposed adjacent or at the outlet end of the diffusing channel 135. The straight line segment BD is tangent to the arcuate line segment AB at the point B, and the straight line segment BD is located on a tangential line to the arcuate line segment AB at the point B. The straight line segment BD has a length d, and a chord length of the arcuate line segment AB, i.e. a straight line distance between point A to point B, is b. In this embodiment, d/b is in the range of 0.2 to 0.3. A chord height of the arcuate line segment AB, i.e. a perpendicular distance from a point C on the arcuate line segment AB to a straight line segment AB, is c. In this embodiment, c/b is in the range of 0.14 to 0.16. The line L1 has a maximum degree of curvature at the point C. A projection point of the point C on the chord of the arcuate line segment AB is spaced from the point A by a distance a. In this embodiment, a/b is in the range of 0.4 to 0.6. A plane 3 is a radial plane perpendicular to a central axis of the diffuser 13 and passing the point A. A tangential line to the line L1 at the point A and the plane 3 form an angle a therebetween. In this embodiment, a is in the range of 20 to 30 degrees, i.e. the plane 3 and a tangential plane to the curved bottom segment 1351 of the diffusing channel 135 at one end thereof away from the plane bottom segment form an angle in the range of 20 to 30 degrees. The straight line segment BD and the plane 3 form an angle β therebetween. In this embodiment, the angle β is preferably 90 degrees, i.e. the plane bottom segment 1353 of the diffusing channel 135 is parallel to the central axis of the diffuser 13.

Figure 10:
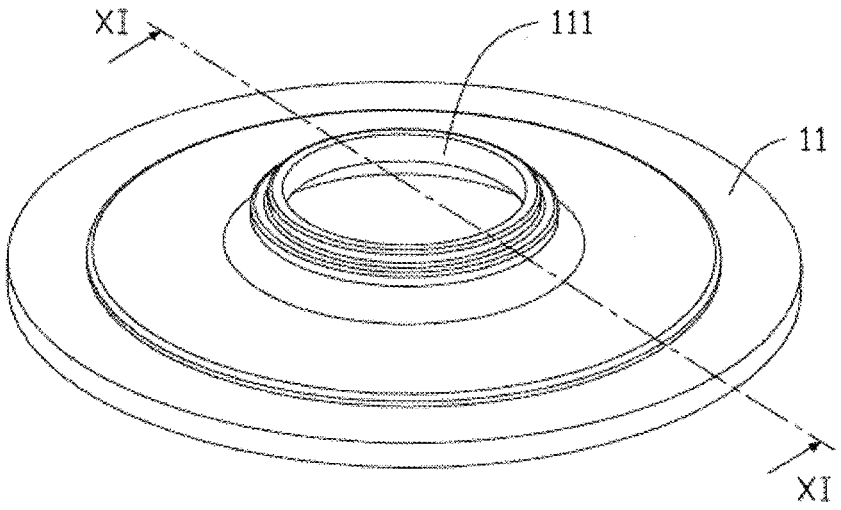
FIG. 10 is a perspective view of a cover body used in the airflow generating apparatus of FIG. 1.
Figure 11:
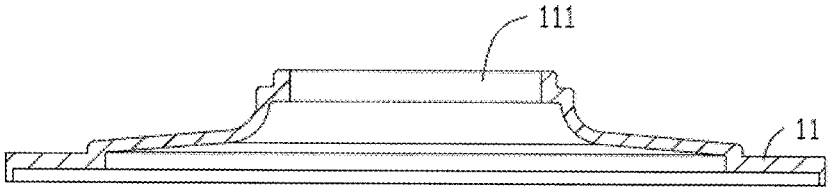
FIG. 11 is a sectional view of the cover body of FIG. 10, taken along line XI-XI thereof.
Figure 12:
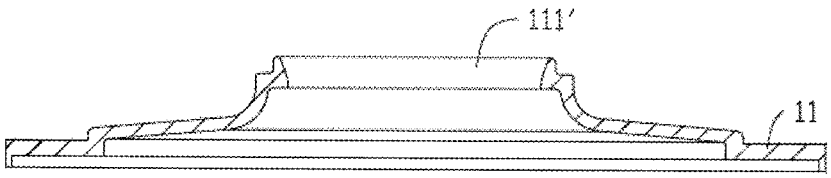
FIG. 12 is a sectional view of an alternative cover body used in the airflow generating apparatus of FIG. 1.

Referring to FIG. 10 to FIG. 12, the cover body 11 is of a stepped configuration which has a top portion at a center position thereof. An opening 111 is defined in the top portion. In one embodiment, the opening 111 is cylindrical. In another embodiment, the top portion of the cover body 11 defines an opening 111'. Preferably, the opening 111' is substantially trumpet-shaped which has a caliber at its upper end greater than its caliber at its lower end. As far as the opening 111 and the opening 111' in the above two embodiments are concerned, under the condition that the calibers at the lower ends are the same, if the cover body 11 is formed by injection molding, considering that the top portion bounding the opening 111' requires a certain thickness to maintain its rigidity, a volume ratio of the opening 111' to the opening 111 may be controlled to be greater than 1 and less than or equal to 1.2. If the cover body 11 is made from another material with good rigidity, such as steel, then the volume ratio of the opening 111' to the opening 111 can be increased to be greater than 1.2. That is, having taken the material, formation and rigidity of the cover body 11 into account, the trumpet-shaped opening 111' can have a greater volume than the cylindrical opening 111, and therefore permits more air to enter the airflow generating apparatus 10 in the same time period during operation of the airflow generating apparatus 10.

Figure 13:
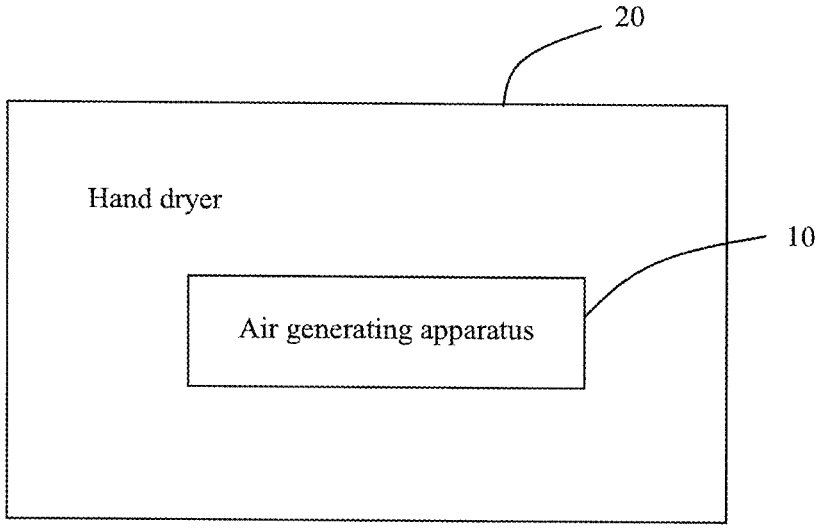
FIG. 13 illustrates the airflow generating apparatus of FIG. 1 used in a hand dryer.

FIG. 13 illustrates a hand dryer 20 which includes the above airflow generating apparatus 10. In this embodiment, other parts of the hand dryer 20 are known in the art and, therefore, are not described in detail herein.

Figure 14:
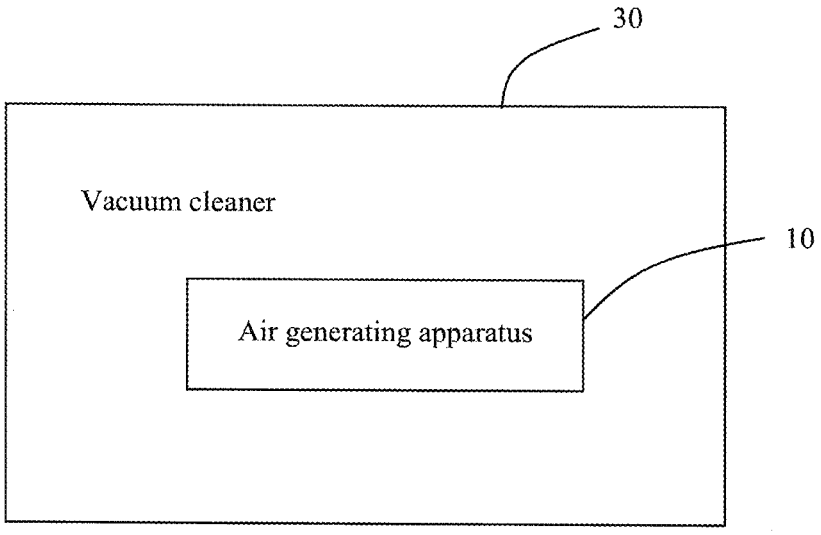
FIG. 14 illustrates the airflow generating apparatus of FIG. 1 used in a vacuum cleaner.

FIG. 14 illustrates a vacuum cleaner 30 which includes the above airflow generating apparatus 10. In this embodiment, other parts of the vacuum cleaner 30 are known in the art and, therefore, are not described in detail herein.

Figure 15:
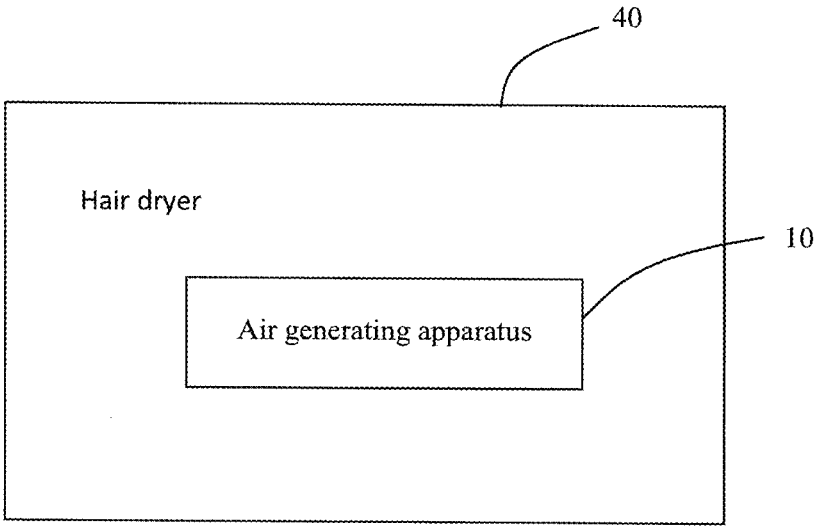
FIG. 15 illustrates the airflow generating apparatus of FIG. 1 used in a hair dryer.

FIG. 15 illustrates a hair dryer 40 which includes the above airflow generating apparatus 10. In this embodiment, other parts of the hair dryer 40 are known in the art and, therefore, are not described in detail herein.

Although the invention is described with reference to one or more preferred embodiments, it should be appreciated by those skilled in the art that various modifications are possible. Therefore, the scope of the invention is to be determined by reference to the claims that follow.

The invention claimed is:

1. An airflow generating apparatus comprising:

a motor comprising a rotary shaft;

an impeller mounted on the rotary shaft of the motor for being driven by the motor, the impeller comprising a plurality of blades, air passages being formed between the blades; and a diffuser surrounding the impeller and comprising a plurality of diffusing vanes, diffusing channels being formed between the diffusing vanes;

wherein, in a flow region defined between a terminating end of one diffusing vane and a starting end of another adjacent diffusing vane, an intersection line between a bottom of the diffusing channel between the two diffusing vanes and a circumferential section of the bottom of the diffusing channel comprises a front arcuate line segment and a subsequent straight line segment, the arcuate line segment extends curvedly, outwardly and downwardly from an inlet end of the diffusing channel or a portion adjacent the inlet end of the diffusing channel, the straight line segment connects to the arcuate line segment and extends to an outlet end of the diffusing channel, wherein the straight line segment is tangent to the arcuate line segment at a point where they are connected to each other, and wherein a chord height of the arcuate line segment is c, a chord length of the arcuate line segment is b, c is 0.14 to 0.16 times b, and a tangential line to the arcuate line segment at one end of the arcuate line segment away from the straight line segment and a plane perpendicular to a central axis of the diffuser form therebetween an angle in the range of 20 to 30 degrees.

2. The airflow generating apparatus of claim 1, wherein the circumferential section of the bottom of the diffusing channel is an airfoil section.

3. The airflow generating apparatus of claim 1, wherein the straight line segment has a length d, and d is 0.2 to 0.3 times b.

4. The airflow generating apparatus of claim 1, wherein the arcuate line segment has a point with a maximum degree of curvature, a projection point of the point with the maximum degree of curvature on a chord of the arcuate line segment is spaced from one end point of the arcuate line segment by a distance a, and a is 0.4 to 0.6 times b.

5. The airflow generating apparatus of claim 1, wherein an angle formed between the straight line segment and the plane perpendicular to the central axis of the diffuser is 90 degrees.

6. The airflow generating apparatus of claim 1, wherein the inlet end of the diffusing channel is spaced from the air passages of the impeller by a gap, the impeller has an outer diameter D1, a circle on which ends of the diffusing vanes at the inlet ends of the diffusing channels are located has a diameter D2, and D1 is 0.85 to 0.98 times D2.

7. The airflow generating apparatus of claim 1, wherein the impeller comprises a front cover plate and a rear cover plate spaced apart by a predetermined distance, the blades are mounted between the front cover plate and the rear cover plate, the front cover plate defines an opening as an inlet of the air passages of the impeller, and an outer circumference of the impeller defines outlets of the air passages.

8. The airflow generating apparatus of claim 1, wherein the diffuser comprises an outer housing and a partition plate mounted within the outer housing, and the plurality of diffusing vanes is formed on the partition plate, a thickness increased stage is formed along an outer circumferential area of the partition plate, and the diffusing vanes extend across the thickness increased stage to an outer edge of the diffuser where the diffusing vanes connect to the outer housing.

9. The airflow generating apparatus of claim 8, wherein the partition plate forms a recessed portion at a middle thereof, and the impeller is disposed in the recessed portion.

10. The airflow generating apparatus of claim 8, wherein the outlet ends of the diffusing channels pass through the partition plate and are disposed adjacent the outer housing, a gap is defined between the outer housing and the outlet ends of the diffusing channels.

11. The airflow generating apparatus of claim 1, wherein the airflow generating apparatus further comprising a cover body defining an opening which acts as an inlet allowing the air to enter the airflow generating apparatus, the opening is trumpet-shaped which has a caliber at its upper end greater than its caliber at its lower end, and a volume of the opening is 1 to 1.2 times a volume of a cylinder having a diameter the same as the caliber at the lower end of the opening and having the same height as the opening.

12. The airflow generating apparatus of claim 1, wherein the airflow generating apparatus further comprising a cover body defining an opening which acts as an inlet allowing the air to enter the airflow generating apparatus, the opening is cylindrical.

13. A diffuser comprising a plurality of diffusing vanes, diffusing channels being formed between the diffusing vanes, wherein in a flow region defined between a terminating end of one diffusing vane and a starting end of another adjacent diffusing vane, an intersection line between a bottom of the diffusing channel between the two diffusing vanes and a circumferential section of the bottom of the diffusing channel comprises a front arcuate line segment and a subsequent straight line segment, the arcuate line segment extends curvedly, outwardly and downwardly from an inlet end of the diffusing channel or a portion adjacent an inlet end of the diffusing channel, the straight line segment connects to the arcuate line segment and extends to an outlet end of the diffusing channel, and wherein a chord height of the arcuate line segment is c, a chord length of the arcuate line segment is b, c is 0.14 to 0.16 times b, and a tangential line to the arcuate line segment at one end of the arcuate line segment away from the straight line segment and a plane perpendicular to a central axis of the diffuser form therebetween an angle in the range of 20 to 30 degrees.

14. The diffuser of claim 13, wherein the circumferential section of the bottom of the diffusing channel is an airfoil section, the straight line segment is tangent to the arcuate line segment at a point where they are connected to each other.

15. The diffuser of claim 13, wherein the straight line segment has a length d, and d is 0.2 to 0.3 times b.

16. The diffuser of claim 13, wherein the arcuate line segment has a point with a maximum degree of curvature, a projection point of the point with the maximum degree of curvature on a chord of the arcuate line segment is spaced from one end point of the arcuate line segment by a distance a, and a is 0.4 to 0.6 times b.

17. An electrical device comprising an airflow generating apparatus, the airflow generating apparatus comprising:

a motor comprising a rotary shaft;

an impeller mounted on the rotary shaft of the motor for being driven by the motor, the impeller comprising a plurality of blades, air passages being formed between the blades; and a diffuser surrounding the impeller and comprising a plurality of diffusing vanes, diffusing channels being formed between the diffusing vanes;

wherein, in a flow region defined between a terminating end of one diffusing vane and a starting end of another adjacent diffusing vane, an intersection line between a bottom of the diffusing channel between the two diffusing vanes and a circumferential section of the bottom of the diffusing channel comprises a front arcuate line segment and a subsequent straight line segment, the arcuate line segment extends curvedly, outwardly and downwardly from an inlet end of the diffusing channel or a portion adjacent an inlet end of the diffusing channel, the straight line segment connects to the arcuate line segment and extends to an outlet end of the diffusing channel, and wherein a chord height of the arcuate line segment is c, a chord length of the arcuate line segment is b, c is 0.14 to 0.16 times b, and a tangential line to the arcuate line segment at one end of the arcuate line segment away from the straight line segment and a plane perpendicular to a central axis of the diffuser form therebetween an angle in the range of 20 to 30 degrees; and wherein the electrical device is a hand dryer, a vacuum cleaner, or a hair dryer.

* * * * *